US006427505B2

(12) United States Patent
Imedio Ocaña

(10) Patent No.: US 6,427,505 B2
(45) Date of Patent: Aug. 6, 2002

(54) LATCH MECHANISM FOR ELECTRONIC LOCKS

(75) Inventor: Juan Antonio Imedio Ocaña, Fuenterrabia (ES)

(73) Assignee: Escudos Kala Internacional, S.L., San Sebastian (ES)

( * ) Notice: Subject to any disclaimer, the term of this patent is extended or adjusted under 35 U.S.C. 154(b) by 16 days.

(21) Appl. No.: 09/764,835

(22) Filed: Jan. 17, 2001

(30) Foreign Application Priority Data

Mar. 1, 2000 (ES) ..... 200000492

(51) Int. Cl.[7] ..... E05B 15/16
(52) U.S. Cl. ..... 70/422; 70/278; 70/481
(58) Field of Search ..... 70/278.6, 278.7, 70/283, 283.1, 422, 467, 481, 482

(56) References Cited

U.S. PATENT DOCUMENTS 4,667,994 A * 5/1987 Foshee ..... 292/1
6,053,019 A * 4/2000 Wilk et al. ..... 70/283

FOREIGN PATENT DOCUMENTS

EP 1040243 A1 * 10/2000

* cited by examiner

*Primary Examiner*—Anthony Knight
*Assistant Examiner*—Michael J. Kyle
(74) *Attorney, Agent, or Firm*—Klauber & Jackson

(57) ABSTRACT

It is fitted in the inner escutcheon and is able to be adapted to any lock and in left- and right-handed doors. Once the lock has been opened, after a certain length of time it becomes locked again even though the handle has not been turned. It includes two inner (12) and outer (11) square bars in prolongation, connected to individual tumblers (21, 22) and bearing the operating handles. Both tumblers (21, 22) have a relative angular displacement, turning simultaneously, after the release of a displaceable piece (23) or latch, introduced into a groove (214) of the outer tumbler (21), the latch (23) being assisted by a spring (30). The latch (23) is displaceable from the inside by means of rocker arms (24, 25) operated by lugs (224, 225) of the inner tumbler (22), projecting from the groove (214). From the outside, a reducer motor (40) acts on an endless screw (401), which displaces the spring (30) connected to the latch (23) through a certain angle in order to release it.

5 Claims, 5 Drawing Sheets

LATCH MECHANISM FOR ELECTRONIC LOCKS

OBJECT OF THE INVENTION

This invention, according to the statement of this description, refers to a latch mechanism for electronic locks and involves notable relevant and advantageous characteristics compared to present mechanisms that can be regarded as being of its type.

It is installed in the inner escutcheon of the lock and it is valid for doors that close on the left or on the right, and it is able to be adapted to locks whose escutcheon is very narrow such as in the case of locks for metal frames.

As it is located inside the escutcheon, this means that it can be used with a wide range of mortise locks, and advantage can even be taken of those that have already been installed, simply by changing the metal escutcheons for these electronic configuration ones.

The placement of the latch mechanism inside the inner escutcheon provides the advantages of greater security and better aesthetics.

It grants greater security because the lock is protected against being manipulated from the outside and against adverse climatic conditions.

Better aesthetics are also achieved because the outer escutcheon does not need any extraordinary dimensions for housing the latch mechanisms given that it lacks them.

BACKGROUND OF THE INVENTION

Electronic locks are characterized in that they have a mechanical lock that physically secures the door to the frame and in that they have certain electronic means for authorizing the opening of that lock. The electronic means include a reader permitting the reading of data on a coded medium that can take different forms and different technologies, such as for example a magnetic card, a proximity card, a key with memory, etc. We will in general name these coded media as keys. When a key with valid data is presented, the electronic control permits the outer handle to operate one of the shafts of the mechanical lock, either by means of releasing a latch that was preventing the handle from turning or by means of activation of a clutch that connects the shaft of the handle to the shaft of the lock.

Mechanical locks can have one or several shafts. Some open the catch bolt and are usually operated by a handle or a knob. Others open or close a lever and are usually operated by means of a cylinder either with a key, or with a rotating knob. The electronic control can govern the action of one or several of the shafts depending on the applications of the lock.

In the description that follows, we refer to the shaft that controls the catch bolt of the lock and which is operated with a turn that is usually smaller than 90° actuated by a handle or knob and forced by a spring to return to the initial rest position.

Moreover, the handle of the inner side of the door must always open the lock without the intervention of any electronic control in order to permit exit in the case of emergency. This feature is known as anti-panic.

There are numerous patents on electronic locks that describe latch mechanisms that are housed in the outer escutcheon and in which the shaft of the handle is divided into two halves. The outer half is controlled by the latch and the inner one always functions operated by the inner handle.

An improvement is to locate the latch in the inner side of the door rather than in the outside. This is a more secure solution since the system is then protected from possible manipulations. It is more reliable from the environmental point of view since the inner side usually suffers smaller variations in temperature and humidity. It can also be more aesthetic since the outer escutcheon does not have to house the latch mechanism.

Invention patent FR 2772817 describes a latch mechanism housed in the inner escutcheon and controlled by an electromagnetic vent.

The mechanism suffers from the defect of having one mounting position, in other words, it is left-handed or right-handed, and when the lock is fitted in doors of the opposite handedness, then the mechanism needs to be dismantled in order to reverse it and assemble it again, with the drawbacks for the user and risk of malfunctioning due to the handling of critical mechanisms.

The electromagnetic vent has a permanent magnet that retains the latch in its secure position. The electronic control supplies an electric current in order to cancel the magnetic field of the magnet and in this way the latch is released, pulled by a spring. Given that electromagnetic vents are efficient for retaining the armature but not for attracting it if it is a few millimeters away, the turning of the handle is used during the opening for resetting the system to its secure state. This compromises the security since if the user acts on the lock with his electronic key but fails to turn the handle, the lock remains open for an indefinite length of time.

In order to achieve the anti-panic function from the inside, the shafts of the outer or inner handles are not completely joined together but instead one drags the other after a certain rotation at no load. When the inner handle is turned these degrees of rotation at no load are exploited in order to withdraw the latch by means of a cam, in such a way that when it starts to drag the outer shaft, this shaft will already have been released. Given that the latch needs to penetrate into the piece that it locks by a minimum depth in order to be secure, the cam will have the appropriate profile for displacing the latch through that distance an angle that will preferably be as small as possible. If this angle is made too small, the profile of the cam will be very sharp and the functioning of the mechanism will not be smooth, and there will be a risk of getting blocked if the two pieces become wedged together.

Moreover, the security of the lock is based on the stresses that the latch can resist without either breaking or deforming when a torque is applied to the outer handle. These stresses are inversely proportional to the distance from the latch to the center of the axis of the mechanism. In the design described by the aforementioned patent FR 2771817 this distance has to be less than half the width of the escutcheon for the lock, which means that the narrower it is wished to make the lock, the greater are the resistance requirements for the pieces.

DESCRIPTION OF THE INVENTION

In general terms, the latch mechanism for electronic locks, which constitutes the object of the invention, solves the problems mentioned above, though maintaining the advantages of being housed in the inner escutcheon and of being able to be adopted to any lock.

By means of a totally different design of the latch mechanism, the following advantages are obtained:

- The mechanism has no "handedness" so it can be fitted to left-handed and right-handed doors without any need to manipulate the mechanisms.
- Once the lock has been opened, and following an interval of time, it closes again even if the handle has not been turned.

The pre-turning of the inner handle before the door is opened is made very small, though without doing away with the smoothness of the lock's functioning and maintaining the width of the lock at minimum dimensions.

The distance from the latch to the axis of rotation can be greater than half the width of the lock, thereby reducing the stresses borne by the pieces producing the locking.

The electronic lock includes an inner escutcheon and an outer one, with square bars emerging from them and ending in the operating handles. The inner escutcheon contains the electronic control circuit and is supplied by batteries, acting on the latch mechanism itself. Moreover, the outer escutcheon is the element that supports the key reader.

The square bars act on the tumbler divided into two parts which make contact together and which we will refer to as the inner tumbler and the outer tumbler, depending on which side of the door they are fitted. Both square bars are axially connected though one can rotate with respect to the other to the degree that the tumblers do so as well; these tumblers have a relative rotary movement, though they are limited by stops in both one direction and the other. The outer tumbler is immobilized by the latch device materialized by a prismatic piece inserted in a notch or groove of that tumbler. The inner tumbler can be displaced through an angle to the degree established by the relative rotation with respect to the outer tumbler, after which both rotate together simultaneously so that the lock can open after the key reader connected electrically to the electronic control circuit accepts a key as being valid. At that moment the motor for the latch mechanism is operated in order to release the outer square bar for a few seconds in order to permit the outer handle to open the lock. This operation takes place when the door is opened from the outside. On the other hand, when the lock is operated from the inner handle, the inner tumbler rotates through the angle permitted by the free rotation mentioned earlier and during this movement the latch of the outer tumbler is mechanically released, permitting the simultaneous rotation of both tumblers to continue in order to open the lock.

The tumblers possess certain complementary lugs and windows or recesses for producing the follower action once the locking means are released.

The piece that materializes the latch is displaceable by a pair of rocker arms, which are in turn actuated by one of the two lugs provided in the lower part of the inner tumbler, with one or the other acting depending on the direction of rotation.

This latch is assisted by a spring defined by a helicoidal winding with two extensions or arms, one of which makes contact with the latch and the other is linked to an endless screw that rotates when a reducer motor is operated. Depending on the direction of rotation, the latch becomes engaged or disengaged with respect to the outer tumbler.

In order to limit the stress of rotation on the outer handle when an attempt is made to force the lock, the outermost half of the outer square bar has been provided with peripheral cuts where the square bar would break if the established limits are exceeded.

In order to facilitate an understanding of the characteristics of the invention and forming an integral part of this description, attached are some sheets of plans in whose figures the following are represented by an illustrative and non-restrictive way:

DESCRIPTION OF AN EMBODIMENT OF THE INVENTION

Figure 1:
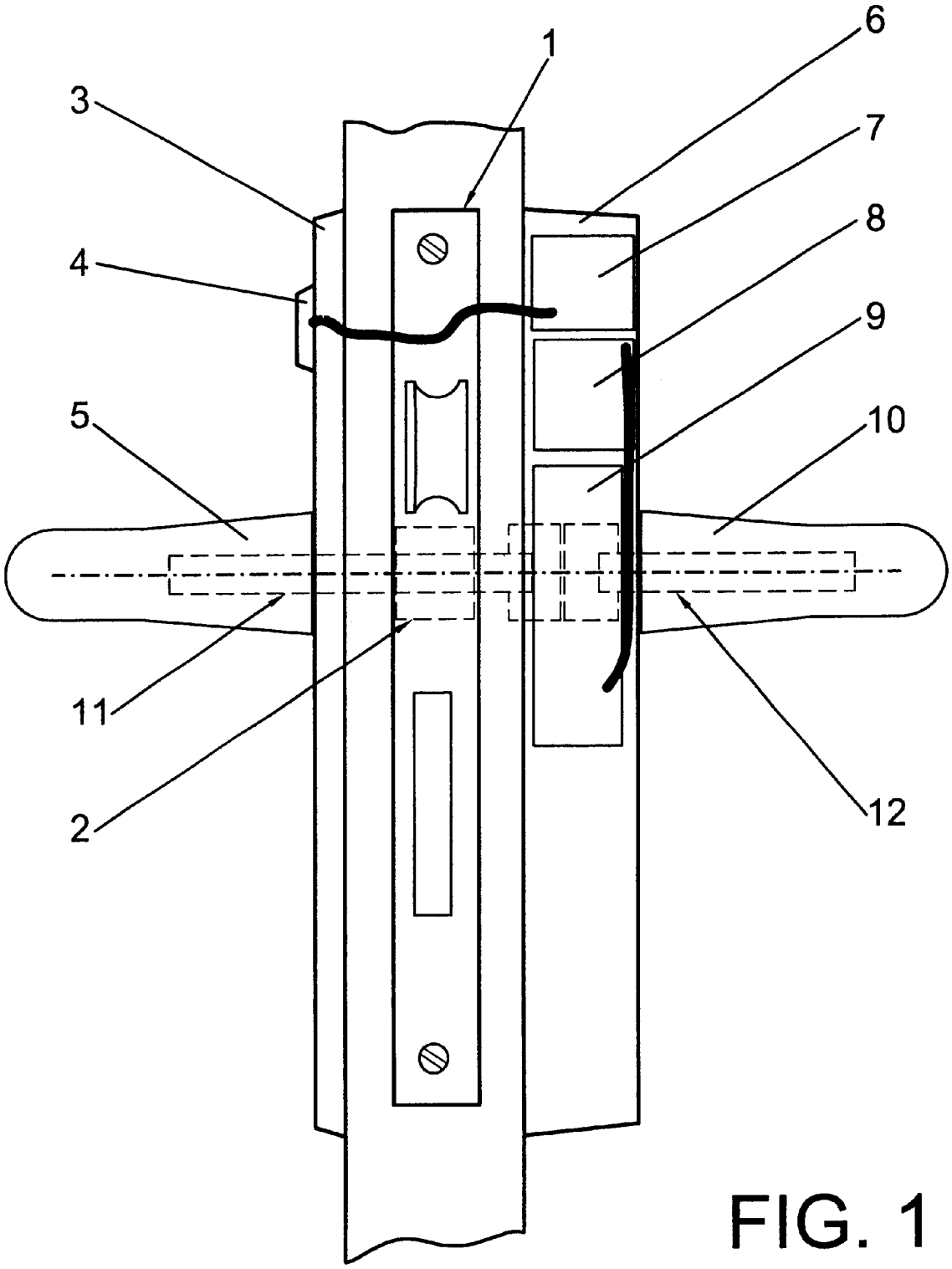
FIG. 1. Is a schematic view in front elevation of an electronic lock including the latch mechanism which is the object of the invention, being located in a door and the lock being the of the mortise type.

Referring to the numbering system adopted in the figures, we can see how the electronic lock comprises two escutcheons: the outer escutcheon 3 which supports the key reader 4 and an outer handle 5. The inner escutcheon 6 contains the electronic control circuit 7 supplied by batteries 8, the latch mechanism 9 and an inner handle 10.

Projecting from the latch mechanism 9 are two square bars: the outer square bar 11 which acts on the tumbler 2 of the lock and which links with the outer handle 5, and the inner square bar 12 which links with the inner handle 10. The outer square bar 11 is immobilized by a latch electrically controlled by the control circuit 7 and the inner square bar 12 can rotate freely until it starts to drag the outer square bar 11, as will be described in the subsequent figures.

The key reader 4 is electrically connected to the control 7. When a valid key is presented, the control supplies power for the motor of the latch mechanism by means of wires, and this motor releases the outer square bar 11 for a few seconds, permitting the outer handle 5 to open the lock.

In FIG. 1 a mortise lock 1 has been represented in which the catch bolt is withdrawn when its tumbler 2 is rotated. The embodiment shown is given by way of an example and in it, neither the type of key reader used nor the exact arrangement of the mortise lock are important.

Figure 2:
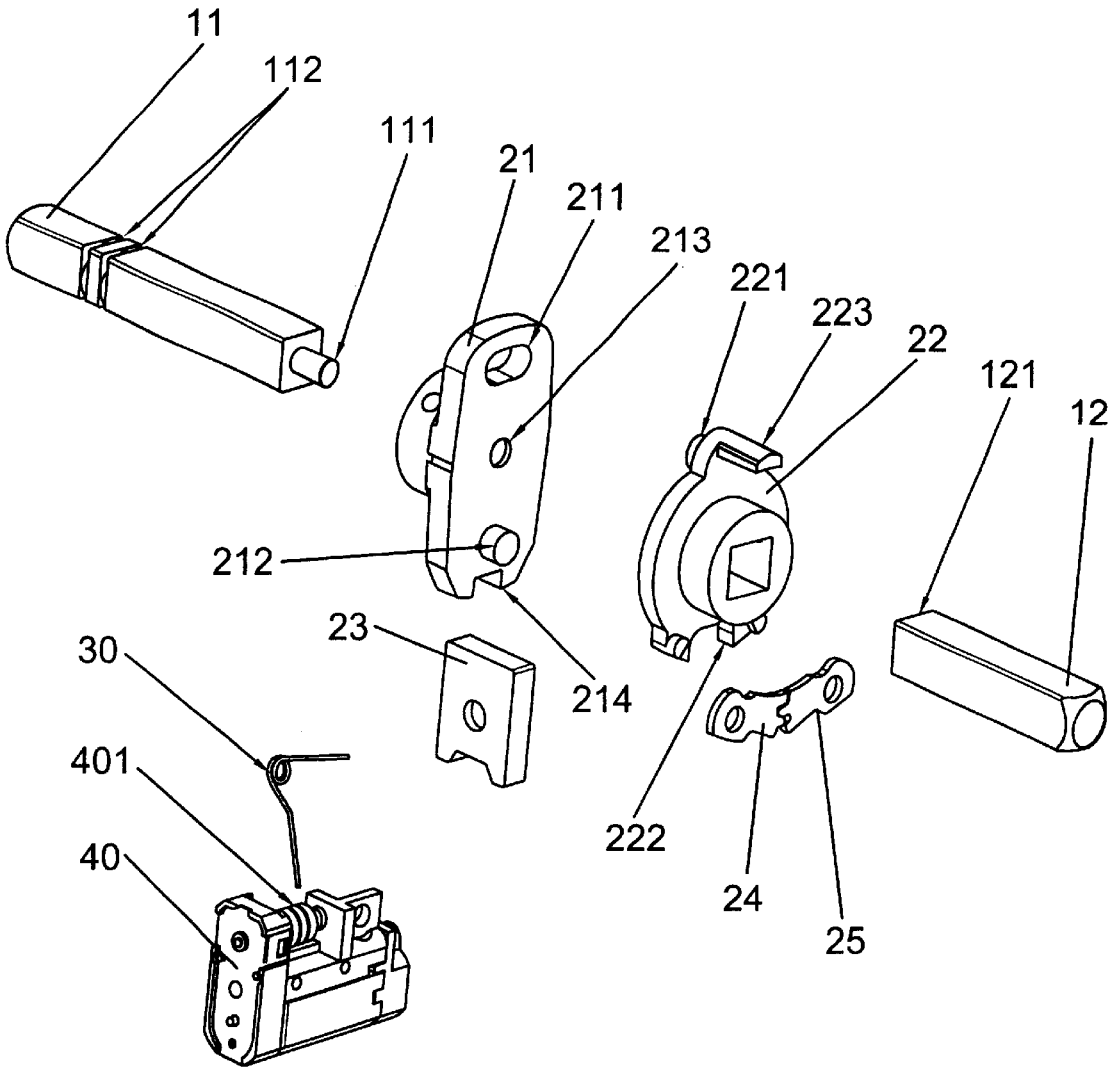
FIG. 2. Is an exploded perspective view of the different pieces involved in the latch mechanism, having removed the housing in which they are all supported.

FIG. 2 represents an exploded view of the latch mechanism 9 without including the support piece or housing.

The outer square bar 11 is fixed to the outer tumbler 21 with the aid of a stud bolt not represented in the figure.

Figure 7:
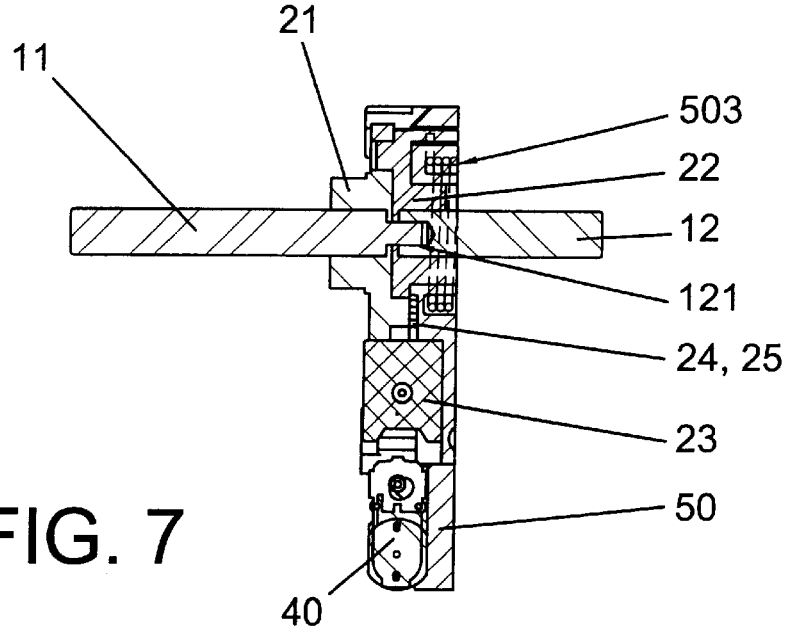
FIG. 7. Is a section in elevation view following a plane passing through the axis of the square bars, including the support piece or housing.

The outer square bar 11 has a projecting shaft 111 which passes through the hole 213 in the outer tumbler 21 and is housed in the cavity 121 of the inner square bar 12 in order to improve the alignment of the pieces (see also FIG. 7).

When the outer square bar 11 and the outer tumbler 21 cannot rotate because the groove 214 interferes with the latch 23, the outer handle 5 fixed to the outer square bar 11 cannot rotate either. This square bar displays certain cuts 112 in its outermost half, which act as stress fuses so that, in the event of very large torques being applied to the outer handle 5, as in a fraudulent action, the square bar breaks in advance of the tumbler 2 of the lock, disconnecting the outer handle 5 from the rest of the unit and maintaining the security of the system.

The inner square bar 12 is fixed to the inner tumbler 22 with the aid of another stud bolt not represented in this figure.

The outer tumbler 21 and the inner tumbler 22 have their flat surfaces resting between each other and are aligned by the projecting shaft 111. The outer tumbler 21 has a lug 212 that matches a cut 222 made in the profile of the inner tumbler 22 and this has another lug 221 which is introduced into a slot 211 of the outer tumbler 21. Both tumblers can freely rotate between each other by an angle of a few degrees until the lugs 212 and 221 reach the end of the travel of the cut 222 and the slot 211. Starting from that angle they drag. each other.

The latch 23 is a piece with a parallelepiped shape that can move a few millimeters up and down in vertical direction guided by some cuts made in the support piece, which is not shown in this figure. When it moves up it becomes introduced into the groove 214 between the outer tumbler 21, thus preventing its rotation since the latch 23 is fully restricted in terms of lateral displacements. The latch 23 moves up and down due to the effect of the spring 30, which is in turn moved by the endless screw of a reducer motor 40. It can also be displaced downwards by the two rocker arms 24 and 25.

Figure 3:
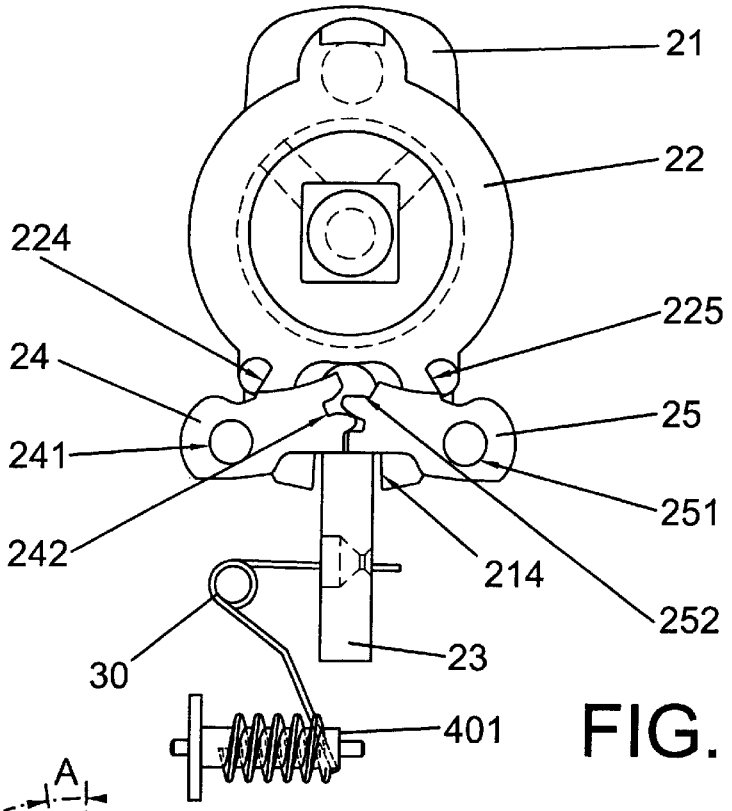
FIG. 3. Is an elevation view in order to see the position of the pieces of FIG. 2 when the lock is closed and the inner handle is at rest.

FIG. 3 shows the positions of the tumblers 21 and 22, of the rocker arms 24 and 25, of the latch 23 and of the spring 30 when the lock is latched and the handles are at rest.

The outer tumbler 21 is in centered position. The inner tumbler 22 is also centered by the spring of the inner handle 503, which can be seen in FIG. 9.

The inner tumbler 22 has two shifter lugs 224 and 225 which act on the upper profiles of the rocker arms 24 and 25. These have two holes 241 and 251 which allow them to rotate on two shafts 502 and 504 of the support 50, shown in FIG. 8.

The latch 23 is in its upper position pushed by the spring 30 and inserted in the groove 214. It also pushes the rocker arms 24 and 25 to their upper position permitted by the shifter lugs 224 and 225, since they are centered.

When a valid key is read, the control actuates the reducer motor 40 in such a way that the endless screw 401 moves the inner arm of the spring 30 causing it to rotate in the clockwise direction and with the axis of rotation centered on its winding. The other arm of the spring 30 will lower the latch 23 which, when it exits from the groove 214, releases the outer tumbler 21. In these conditions, the outer handle 5 can be operated in order to open the lock. After a pre-set time has passed, the control operates the motor 40 in the opposite direction, rotating the spring 30 in the anti-clockwise direction and causing the latch 23 to lock again the outer tumbler 21.

The other way of opening the lock is from the inner side, without the intervention of electronics.

Figure 4:
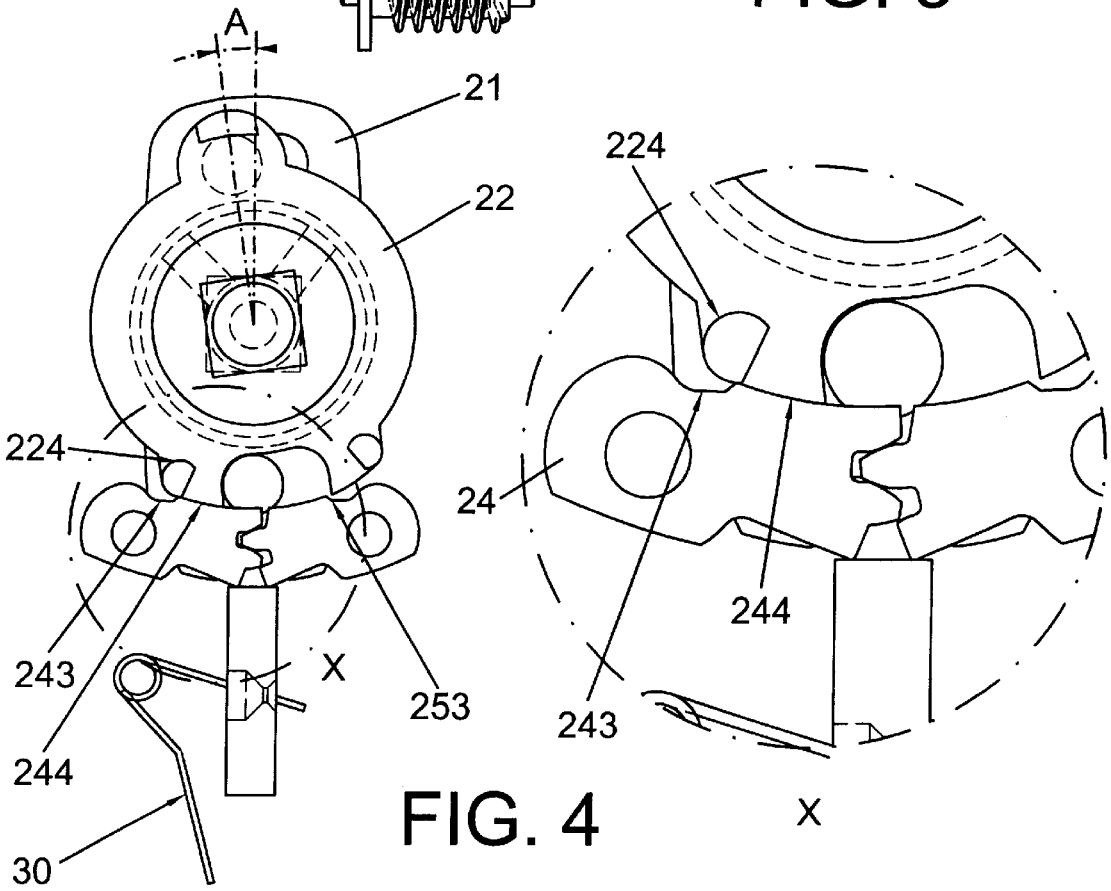
FIG. 4. Is a view similar to that of FIG. 3, in a position in which the inner handle has been rotated a little and has withdrawn the latch by mechanical means, including a detail on a larger scale.

FIG. 4 shows what happens when the inner handle is turned slightly.

The inner tumbler 22, moved by the handle, rotates through an angle A of a few degrees, for example 5°. The outer tumbler 21 does not rotate since the lugs 212 and 221 move freely inside the slots 211 and 222.

Nevertheless, the shifter lug 224 acting on the step 243 of the upper profile of the rocker arm 24, causes the latter to rotate and push downwards on the latch 23, taking it out from the groove 214. Continuing the rotation beyond angle A, the inner tumbler 22 will drag the outer tumbler 21, which can rotate since it is not secured. The opening is achieved without the intervention of the electric means since the spring 30 has not been moved by the motor and it has only been contracted due to the fact that, as we will recall, we are operating the lock from the inner side.

It is precisely a basic aspect of the mechanism the fact that there exists that interaction between the tumbler and the rocker arms in order to cause the retraction of the latch with a minimum rotation; with assured smoothness and also maintaining the width of the mechanisms at certain values that are also minima.

As can be seen more clearly in the detail "X" of FIG. 4, the upper profile of the rocker arm 24 has a first part step-shaped 243 on which the shifter lug 224 acts. When it is at rest, FIG. 3, the axes of rotation of the tumbler 22 and of the rocker arm 24, the shifter lug 224 and the step 243 are almost aligned. The circumference described by the shifter lug 224 is tangent to that described by the step 223, in such a way that when the former pushes the latter, it does so with a component that is tangent to the curves of its movements, due to which the smoothness of the mechanism is extreme.

In addition, a very high multiplying effect of displacements is achieved since the distance and center of rotation of the rocker arm 24 to the end resting on the latch 23 is almost three times larger than the distance to the step 243.

Without this multiplying effect, the pre-turning of the inner handle for retracting the latch would have to be very large, which is not acceptable in terms of user comfort. Alternately, the radius of the inner tumbler would have to be increased, since with the same angle of displacement of the lugs it is proportional to the radius. This would be contrary to the aim of maintaining the width of the lock with the least possible stress.

The upper profile of the rocker arm 24 is extended in a circumferential arc 244 whose center is the axis of rotation of the tumbler 22, in such a way that when the tumbler 22 continues to rotate it does not force the latch 23 to carry on descending further than necessary.

The two rocker arms 24 and 25 present gears 242 and 252 that are complementary and cause one piece to follow the movement of the other. In this way, when the inner tumbler 22 rotates a lot, the shifter lug 224 does not meet the raised rocker arm 25, thereby preventing them from colliding.

Figure 5:
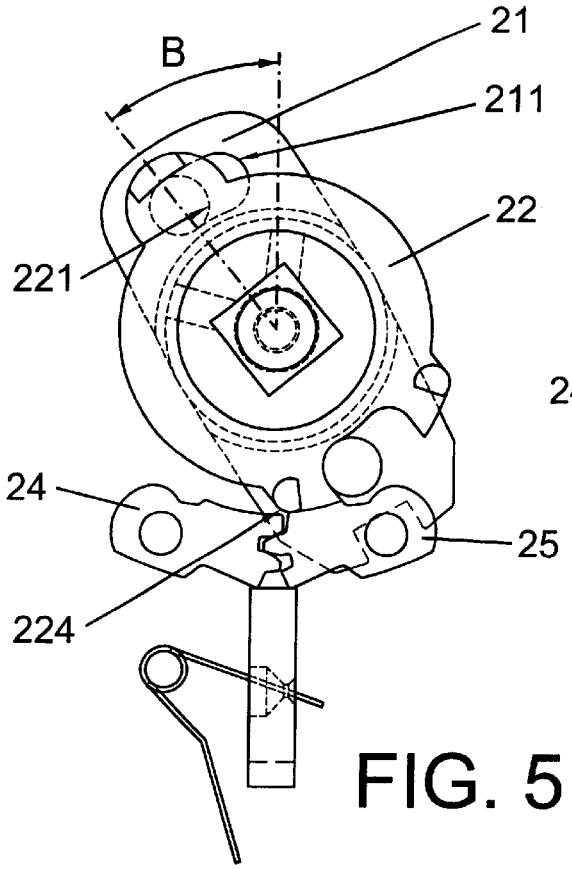
FIG. 5. Is a view similar to FIG. 4, when the inner handle has rotated as far as the stop.

FIG. 5 represents the inner tumbler 22 which has rotated through an angle B, for example 400, dragging along. the outer tumbler 21 as it rotates.

Figure 6:
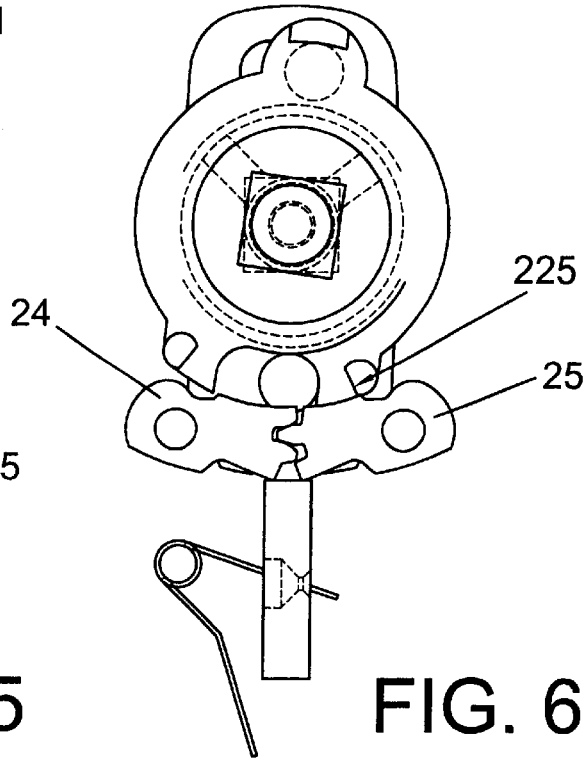
FIG. 6. Is a view similar to that of FIG. 4, when the inner handle has been rotated through the same angle but in the opposite direction.

FIG. 6 represents the same as FIG. 4 when the handle has been turned in the opposite direction. The final effect on the latch 23 is exactly the same but this time it has been achieved by the interaction of the other shifter lug 225 with the other rocker arm 25. The mechanism works in an equivalent way in both directions.

Another advantage of this mechanism is that the pieces that are moved by the spring 30 and by the reducer motor 40 are very small. The size and thickness of the latch 23 is the minimum possible for assuring its resistance towards large torques applied to the outer handle. The rocker arms 24 and 25 are small by design and are made with relatively fine plate since they do not have to bear large stresses. This makes the weight of the three pieces be light and the power of the reducer motor 40 be the least possible, which is very favorable in a lock that is supplied by batteries so that they can be small size and can prolong its life.

FIG. 7 is a vertical cross-section of the mechanism taken along a plane passing through the axis of the square bars 11 and 12. The relative position of the outer tumbler 21 and the inner tumbler 22 can be seen, as can the rocker arms 24 and 25 and the latch 23.

Figure 8:
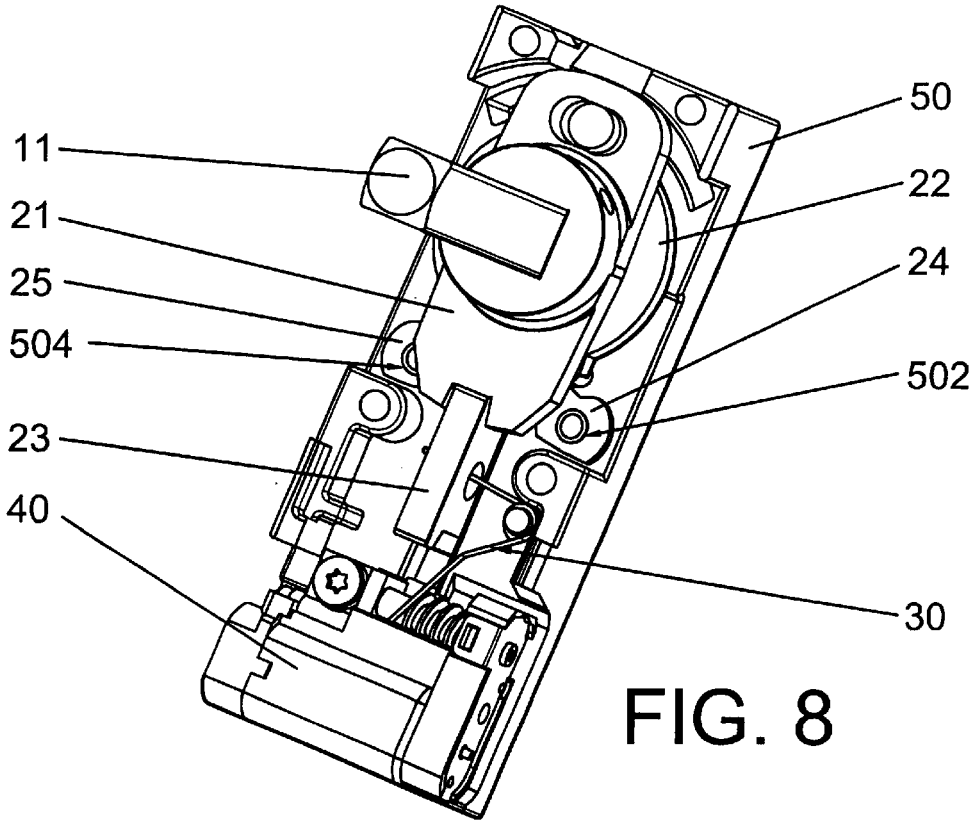
FIG. 8. Is a perspective view of the same lock with all the pieces fitted, seen from the outer side.

FIG. 8 is a view of the mechanism assembly seen from the outside, mounted on the support piece 50. All that is missing is a cover to enclose it and secure the pieces in their position thereby preventing any axial displacement of the assembly formed by the tumblers.

Figure 9:
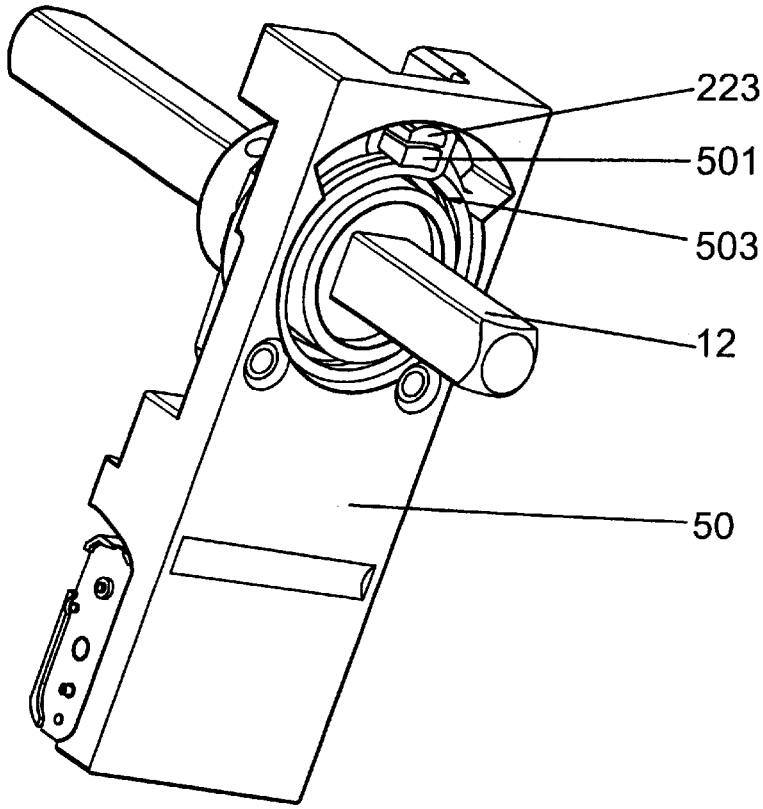
FIG. 9. Is a view similar to FIG. 8, but from the inner side.

Finally, in relation to FIG. 9, where the same assembly is shown from the inner side, it can be seen how the inner spring 503 is acting on the pin 223 of the inner tumbler 22 and on the projection 501 of the support 50, thereby keeping the inner handle in horizontal rest position.

What is claimed is:

1. LATCH MECHANISM FOR ELECTRONIC LOCKS, housed in the inner escutcheon of the electronic lock, wherein the mechanism includes two square bars having: inner and outer members forming an extension of each other, connected by their ends in contact with their respective inner and outer tumblers having flat surfaces, operating handles being carried at the free ends of each respective square bar; with both tumblers being in contact via their flat surfaces and rotating around a common axis defined by a cylindrical axial extension of one of the square bars, which is then inserted into the other square bar; the outer tumbler having an eccentric lug that moves in a cut made in the profile of the inner tumbler which possesses another lug diametrically opposed that moves in a slot of the outer tumbler; a linearly displaceable piece insertable in a notch or groove in the profile of the outer tumbler, preventing rotation thereof and a spring for biasing the linearly displaceable piece in the notch or groove.

2. LATCH MECHANISM FOR ELECTRONIC LOCKS, according to claim 1, wherein the latch is displaceable by means of two rocker arms, actuated by two lugs on the inner tumbler against the action of the spring, to permit simultaneous rotation of both tumblers to open the lock.

3. LATCH MECHANISM FOR ELECTRONIC LOCKS, according to claim 1 or 2, wherein the spring is formed of a helicoidal winding with an arm passing through a hole in the latch and whose other arm is displaceable by an endless screw of a reducer motor, so that the latch can be disengaged in order to permit rotation of the outer tumbler when the outer handle is actuated, and recovering the original locking position when the reducer motor rotates in the opposite direction after a pre-set time interval.

4. LATCH MECHANISM FOR ELECTRONIC LOCKS, according to claim 1, wherein the outer tumbler has a pin actuated by an inner spring which keeps it in position against a fixed stop of the support or housing, in order to keep the inner handle in a horizontal rest position.

5. LATCH MECHANISM FOR ELECTRONIC LOCKS, according to claim 1, wherein the outer square bar presents certain peripheral cuts made in the outermost half, which act as stress fuses in order to limit the turning stress so that the stress fuses break at a certain value.

* * * * *